US007036641B2

(12) United States Patent
Russo et al.

(10) Patent No.: US 7,036,641 B2
(45) Date of Patent: May 2, 2006

(54) BACKPACK WITH REMOVABLE HANDLE AND WHEEL ASSEMBLY

(75) Inventors: Steve Russo, New York, NY (US); Tung Cheng Chi, Kowloon (HK)

(73) Assignee: Fashion Accessory Bazaar LLC, New York, NY (US)

( * ) Notice: Subject to any disclaimer, the term of this patent is extended or adjusted under 35 U.S.C. 154(b) by 0 days.

(21) Appl. No.: 10/827,984

(22) Filed: Apr. 19, 2004

(65) Prior Publication Data

US 2005/0103589 A1 May 19, 2005

Related U.S. Application Data

(60) Provisional application No. 60/523,780, filed on Nov. 19, 2003.

(51) Int. Cl.
*A45C 5/14* (2006.01)

(52) U.S. Cl. ..... 190/18 A; 190/39; 190/115; 280/47.15; 280/47.315

(58) Field of Classification Search ..... 190/18 A, 190/18 R, 39, 102, 108, 110, 115; 224/153; 280/37, 47.18, 47.315
See application file for complete search history.

(56) References Cited

U.S. PATENT DOCUMENTS

| | | | | |
|---|---|---|---|---|
| 2,372,845 | A * | 4/1945 | Nelson | 190/108 |
| 4,261,447 | A * | 4/1981 | Arias et al. | 190/18 A |
| 4,340,132 | A * | 7/1982 | Cerna | 190/18 A |
| 4,593,841 | A | 6/1986 | Lange | |
| 4,743,038 | A * | 5/1988 | Myers et al. | 280/40 |
| 5,291,976 | A * | 3/1994 | Ku | 190/18 A |
| 5,311,972 | A * | 5/1994 | Plath | 190/102 |
| 5,323,886 | A * | 6/1994 | Chen | 190/18 A |
| 5,375,685 | A | 12/1994 | Plath | |
| 5,634,576 | A * | 6/1997 | Arbel | 224/153 |
| 5,660,476 | A * | 8/1997 | DeCoster | 383/29 |
| 5,664,652 | A * | 9/1997 | Shamah | 190/18 A |
| 5,713,439 | A * | 2/1998 | Zionts et al. | 190/102 |
| 5,749,446 | A * | 5/1998 | Hsieh | 190/107 |
| 5,749,503 | A * | 5/1998 | Wulf et al. | 224/153 |
| 5,788,032 | A * | 8/1998 | Krulik | 190/108 |
| 5,797,617 | A * | 8/1998 | Lin | 280/655 |
| 5,876,048 | A * | 3/1999 | Lee | 280/47.315 |
| 5,984,154 | A * | 11/1999 | Scicluna | 224/153 |
| 6,070,888 | A * | 6/2000 | Wang | 280/37 |
| 6,098,768 | A * | 8/2000 | Tsai | 190/18 A |

(Continued)

FOREIGN PATENT DOCUMENTS

WO WO 99/48404 * 9/1999

*Primary Examiner*—Sue A. Weaver
(74) *Attorney, Agent, or Firm*—Gottlieb,Backman&Reisman

(57) ABSTRACT

A bag carrying system having a removable handle and wheel assembly is provided. The system includes a bag having a back portion with a panel overlying the back portion and a handle and wheel assembly comprising a handle portion, a wheel portion and a longitudinally extending supporting element connected therebetween. Significantly, the longitudinally extending supporting unit of the handle and wheel assembly is designed to be placed between the panel and back portion of the bag for releasably attaching the assembly thereto.

3 Claims, 3 Drawing Sheets

U.S. PATENT DOCUMENTS 6,129,254 A * 10/2000 Yu ..... 224/575
6,253,892 B1 7/2001 Edwards
6,290,114 B1 * 9/2001 Berberian ..... 224/642
6,401,890 B1 6/2002 Tan
2002/0070087 A1 6/2002 Lee
2003/0038008 A1 2/2003 Han
2003/0127296 A1 7/2003 Saetia
2003/0221924 A1 * 12/2003 Tong ..... 190/107
2004/0074725 A1 * 4/2004 Shih ..... 190/115
2004/0238303 A1 * 12/2004 Hafif ..... 190/18 A
2005/0072644 A1 * 4/2005 Gormick et al. ..... 190/111

* cited by examiner

FIG. 3
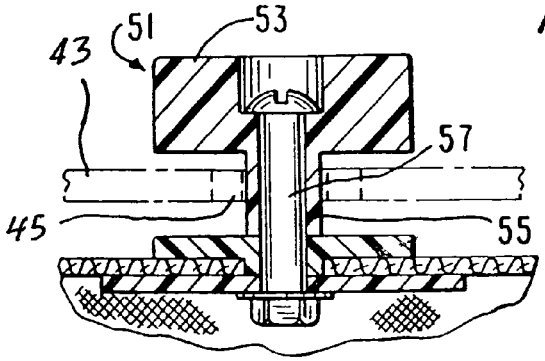
FIG. 4
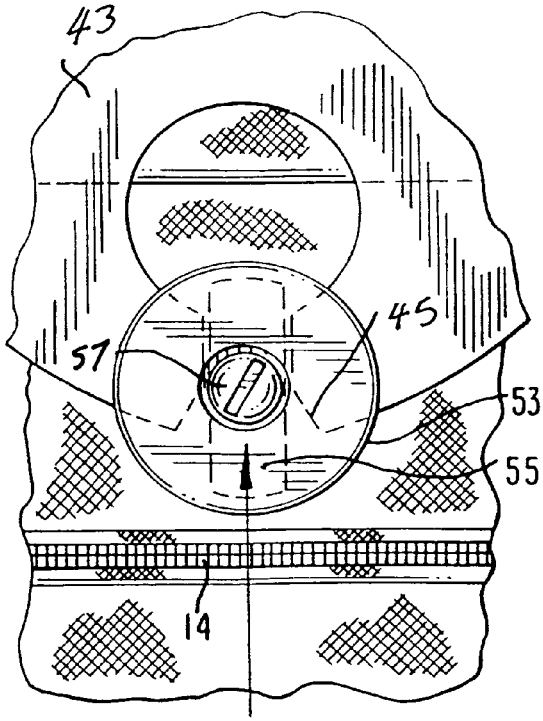
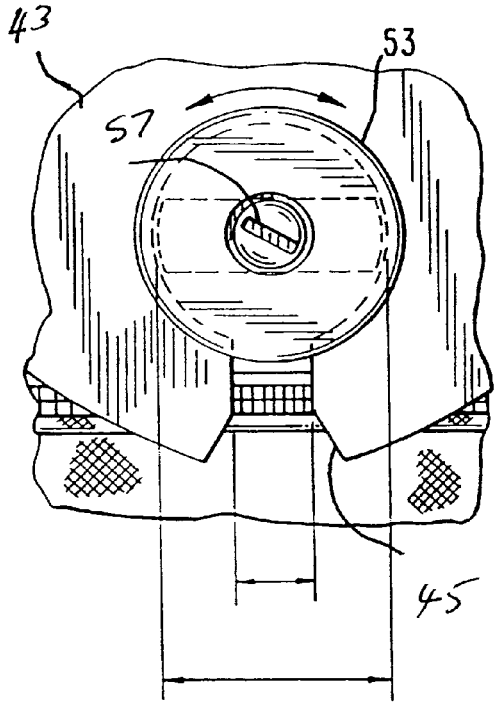
FIG. 5

BACKPACK WITH REMOVABLE HANDLE AND WHEEL ASSEMBLY

BACKGROUND

This application claims priority benefit of provisional application Ser. No. 60/523,780, filed Nov. 19, 2003.

The present invention relates to luggage and bags, and more particularly to a backpack which may either be worn by using a pair of shoulder straps, carried by means of a handle, or wheeled along a surface by means of a removable handle and wheel assembly.

A recent development in the luggage and bag industry has been the use of wheeled baggage and bags. Luggage and bags of this type typically include a wheel unit and an extendable handle so that the user can pull the luggage or bag unit along a flat surface without having to bear the full weight thereof. Moreover, additional items may be supported along the bag or luggage in order to ease the burden of the use, for example, when moving through airports or along the city and suburban side-walks, or even for high school and college students walking between classes.

The most commonly available luggage or bag item of this type has wheels and an extendable handle permanently attached to the bag item. When the luggage or bag item is not being wheeled, the extendable handle is retracted. The disadvantage of this construction is the difficulty in carrying the luggage or bag since the weight of the wheel and handle assembly is often significant.

Accordingly, it would be desirable to provide a luggage or bag system consisting of a bag and a wheel and handle assembly which may be readily secured to the bag when needed and removed when not needed.

SUMMARY OF THE INVENTION

Generally speaking, and in accordance with the invention, a bag carrying system having a removable handle and wheel assembly is provided. The system includes a bag having a back portion with a panel overlying the back portion and the handle and wheel assembly comprising a handle portion, a wheel portion and a longitudinally extending supporting element connected therebetween. Significantly, the longitudinally extending supporting unit of the handle and wheel assembly is designed to be placed between the panel and back portion of the bag for releasably attaching the assembly thereto.

In addition, the bag itself includes one or more engaging elements for selective coupling to the longitudinally extending supporting element of the handle and wheel assembly when the supporting element is disposed between the panel and back portion of the bag. The one or more engagement elements comprise one or more locking elements having either a rotating locking mechanism or a spring loaded locking mechanism.

In a preferred form, at least one locking element is located along the top portion of the bag and a second locking element is located along the bottom portion of the bag. These locking elements are designed to selectively couple to transversely extending trays that extend from the longitudinally extending supporting element of the handle and wheel assembly.

In one form, there are two trays extending from the supporting element of the handle and wheel assembly, one of which engages locking members along the top of the bag and a second which engages locking members along the bottom of the bag. These trays are formed with one or more cut-outs that are designed for mating engagement with the locking members.

In its preferred form, the handle and wheel assembly of the invention includes one or more supporting rods that are connected between the handle portions and the wheel portions. The one or more supporting rods are tubular in form in order to telescopically receive corresponding length adjustment rods therewithin.

The inventive design is most applicable to a backpack, which normally includes a pair of shoulder straps each having first and second ends attached to the back portion of the backpack at locations therealong where the panel does not overly the back portion. This is achieved by having the overlying panel disposed between the attached ends of the straps.

In the preferred form, the panel of the backpack or other type of bag comprises a pivotal flat member that is secured along the back portion of the bag. The flap panel is releasably secured to the back portion of the bag by means of a conventional zipper mechanism.

Accordingly, it is an object of the invention to provide an improved bag carrying system.

Another object of the invention is to provide a bag carrying system having a removable handle and wheel assembly.

Yet a further object of the invention is to provide a bag carrying system comprising a backpack or other bag that can be both worn or carried as well as wheeled along a surface.

Still other objects and advantages of the invention will, in part, be obvious and will, in part, be apparent from the following description.

BRIEF DESCRIPTION OF THE DRAWINGS

For a fuller understanding of the invention, reference is made to the following description, taken in connection with the accompanying drawings in which:

FIG. 3 is a cross-sectional view taken along line 3—3 of FIG. 2;

FIG. 4 is a top plan view showing the locking unit depicted in FIG. 1 as it engages the upper platform of the inventive removable handle and wheel assembly;

FIG. 5 is a top plan view similar to FIG. 4 and illustrating engagement and locking of the locking unit to the upper platform of the inventive removable handle and wheel assembly;

DETAILED DESCRIPTION

Figure 1:
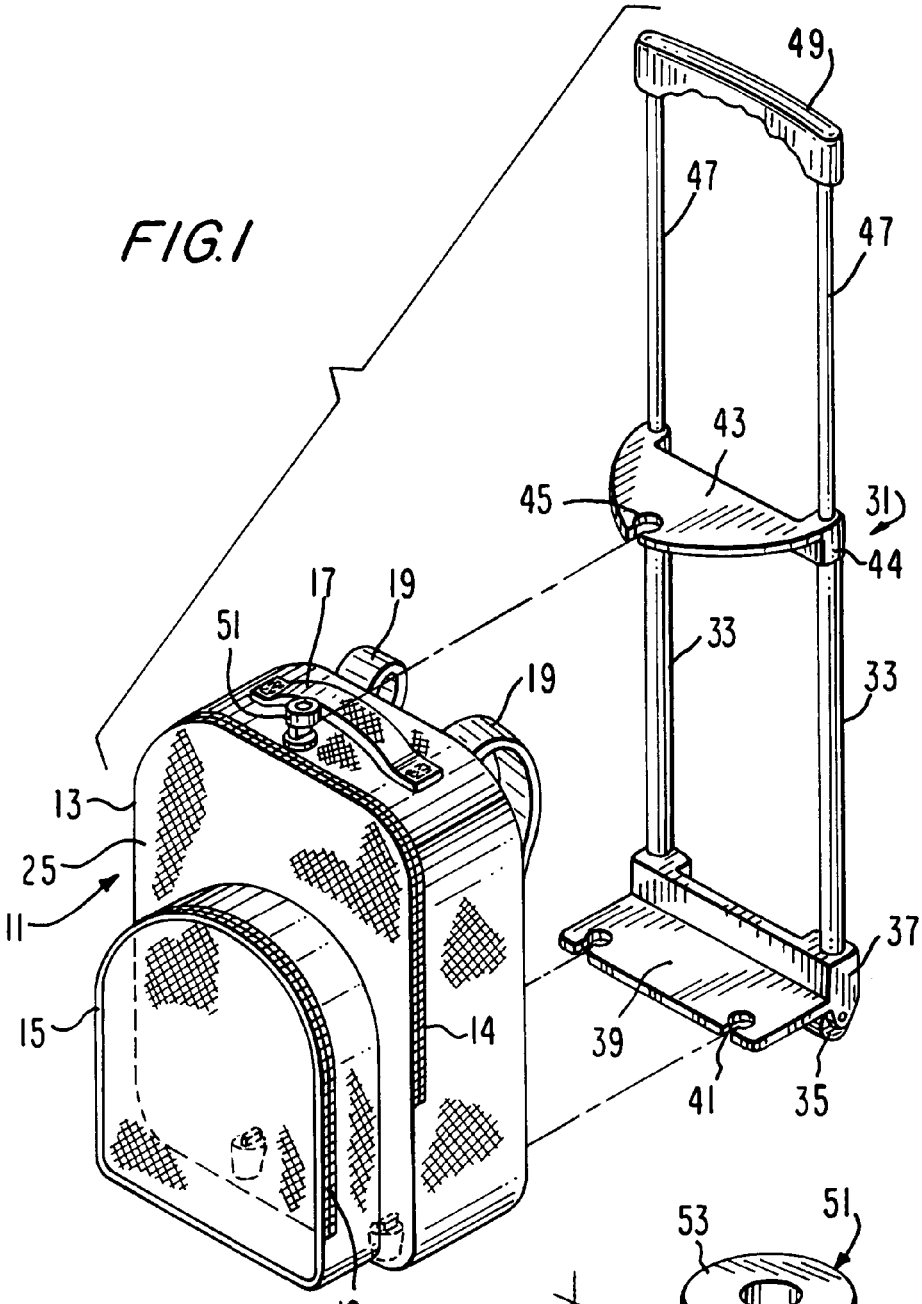
FIG. 1 is an exploded perspective view of the inventive backpack and removable handle and wheel assembly combination.
Figure 6:
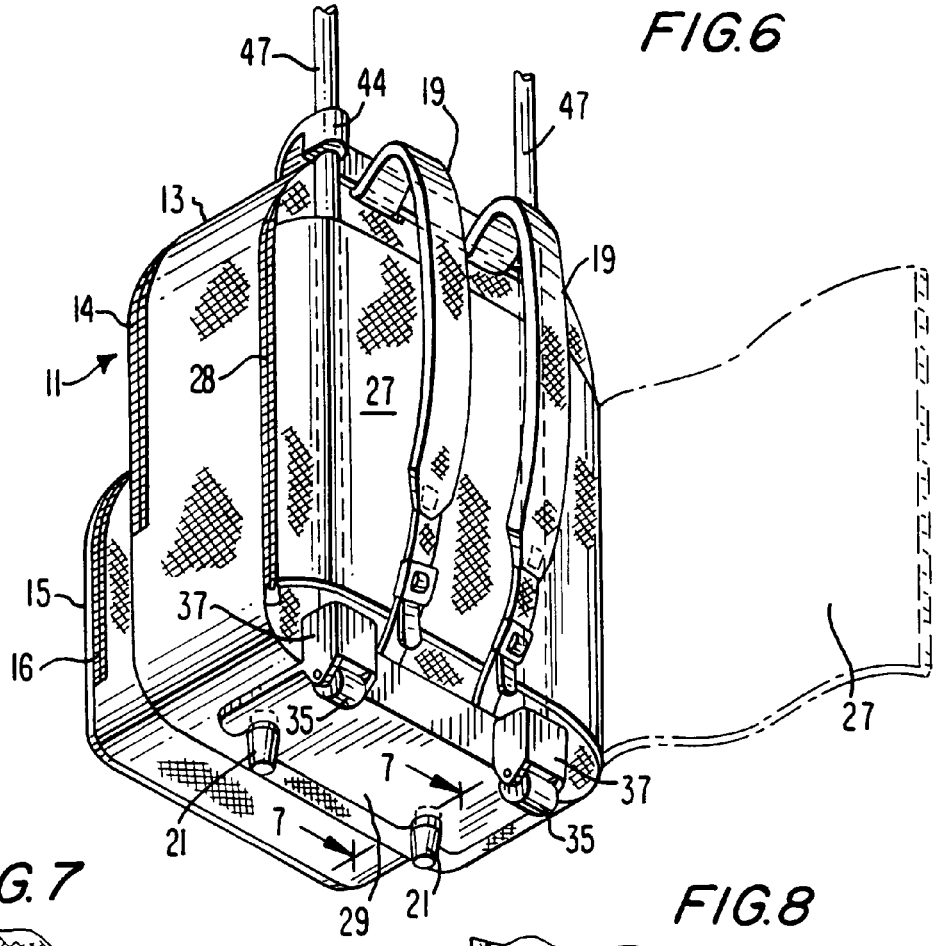
FIG. 6 is a rear perspective view of the backpack and removable handle and wheel assembly combination of the invention in which the removable handle and wheel assembly is disposed along the rear of the backpack and maintained therealong by a removable flap.

The inventive system includes a backpack 11 and a removable handle and wheel assembly 31, as best shown in FIGS. 1 and 6. Backpack 11 is made of a fabric-type material and includes a main compartment 13 accessible via a zipper 14 and a supplemental compartment 15 disposed along front panel 25 of compartment 13 and accessible by means of a zipper 16. Backpack 11 also includes a pair of shoulder supporting straps 19 fixed along the rear of the backpack and a reinforced carrying handle 17 fixed along the top of main compartment 13.

Figure 2:
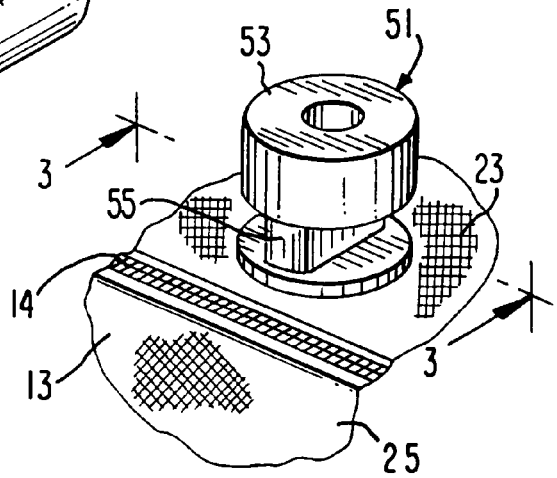
FIG. 2 is a perspective view of a detailed portion along the top of the backpack, illustrating in one version of a locking unit used to releasably couple the handle and wheel assembly to the backpack.
Figure 7:
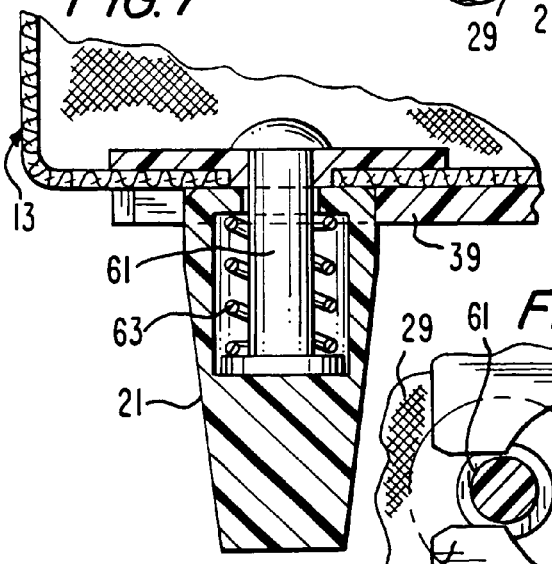
FIG. 7 is a cross-sectional view taken along line 7—7 of FIG. 6 and illustrates the lower platform that extends from the inventive removable handle and wheel assembly engaging to the supporting legs of the backpack.
Figure 8:
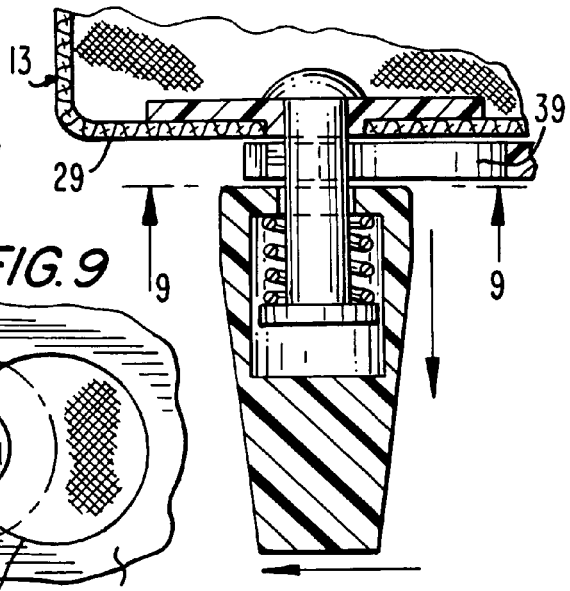
FIG. 8 is a cross-sectional view similar to FIG. 7 in which the supporting legs (spring-loaded) are pulled downwardly in order to release the lower platform of the removable handle and wheel assembly.

In FIG. 2 and FIG. 3, a locking unit 51 comprising a rotating knob 53, a rectangular lock member 55 rotatable by means of knob 53 and a screw 57 fixed therebetween is shown mounted on top 23 of compartment 13. Locking unit 51 is used to removably attach handle and wheel assembly 31 to backpack 11. One or more locking units of this type may also be formed along bottom 29 of main compartment 13. Alternatively, bottom 29, as shown best in FIGS. 6, 7, and 8, includes a pair of feet 21 affixed thereto by means of a spring loaded pin 61 about which a spring 63 is wrapped. This spring loaded mechanism enables each of feet 21 to be pulled downwardly away from bottom 29 of main compartment 13 so that removable handle and wheel assembly 31 can be selectively coupled to feet 21 as described below. This spring loaded mechanism may be used in place of locking unit 51 along the top of the backpack.

Figure 9:
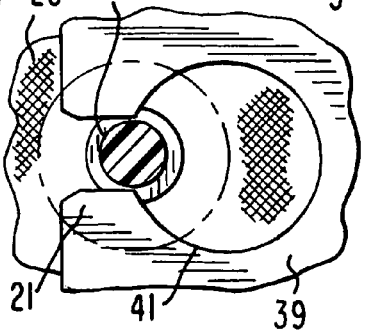
FIG. 9 is a cross-sectional view taken along line 9—9 of FIG. 8

Referring again to FIG. 1, removable handle and wheel assembly 31 comprises metal or plastic support rods 33 extending between an upper platform 43 and a lower platform 39. Support rods 33 at the bottom ends thereof fit into wheel guard supports 37 in which wheels 35 are mounted. Extending from each wheel support 37 is platform 39 formed with a pair of cut-outs 41 used for selectively engaging feet 21 depending from bottom 29 of backpack main compartment 13 (see FIGS. 7–9). At the top of support rods 33 are a pair of platform supports 44 for enabling upper platform 43 to be supported. Platform 43 is formed with a forward notch 45 that is used for selective engagement with locking unit 51 (see FIGS. 3–5). Significantly, support rods 33 are formed with tubular openings therewithin (not shown) such that a pair of upper length or height adjustment rods 47 may be telescopically received therewithin. Rods 47 lead upwardly to a grooved handle 49, which is normally grabbed when wheeling backpack 11. Handle 49 may be disposed in an upper condition during wheeling and a lower condition in which rods 47 are telescopically received within rods 33 such that handle 49 is disposed at the same level as platform 43.

Importantly, the back of backpack 11, as best shown in FIG. 6, is formed with a cushioned panel flap 27 which selectively overlies the back of backpack 11. This enables removable handle and wheel assembly 31 to be disposed between the back of main compartment 13 and flap 27, which is closed by means of zipper 28. In this condition, handle and wheel assembly 31 is usable in conjunction with backpack 11. To remove assembly 31, zipper 28 is unzipped, upper platform 43 is disengaged from locking unit 51 and lower platform 39 is uncoupled from feet 21.

It will thus be seen that the objects set forth above, and those made apparent from the preceding description, are efficiently attained, and since certain changes may be made in the products set forth above without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described, and all statements of the scope of the invention, which, as a matter of language, might be said to fall therebetween.

The invention claimed is:

1. A bag carrying system comprising:

a bag having a back portion, a top portion and a bottom portion;

a bag support assembly including a handle, a wheel portion with a bag support receiving said bag and an interconnecting member extending between said handle and wheel portion; and a locking member selectively attaching said bag to said bag support assembly, and including a cutout and a knob rotatable between a first position in which the rotating knob is captured by said cutout and a second position in which the knob can be inserted into and removed from said cutout.

2. The bag carrying system of claim 1 wherein said interconnecting member has a platform formed with said cutout and wherein said knob is attached to said bag.

3. The bag carrying system of claim 1 wherein said cutout includes a round portion and a neck having a neck width, and said knob includes a rotatable head and a base having a first cross-sectional dimension smaller than said neck width and a second cross-sectional dimension larger than said neck width, so that said knob can be inserted and removed from said cutout with said base facing said neck with said second dimension, and so that said knob is captured by said cutout when said base is facing said neck with said first dimension.

* * * * *